United States Patent [19]

Shimomura

[11] Patent Number: 4,966,112

[45] Date of Patent: Oct. 30, 1990

[54] METHOD FOR ADJUSTING IDLING RPM OF ENGINE

[75] Inventor: Setsuhiro Shimomura, Hyogo, Japan

[73] Assignee: Mitsubishi Denki Kabushiki Kaisha, Tokyo, Japan

[21] Appl. No.: 401,681

[22] Filed: Sep. 1, 1989

[30] Foreign Application Priority Data

Sep. 8, 1988 [JP] Japan ..... 63-225383

[51] Int. Cl.[5] ..... F02M 3/00; F02D 41/16

[52] U.S. Cl. ..... 123/339

[58] Field of Search ..... 123/339

[56] References Cited

U.S. PATENT DOCUMENTS

| | | | |
|---|---|---|---|
| 4,364,347 | 12/1982 | Miyagi | 123/339 |
| 4,469,064 | 9/1984 | Manaka et al. | 123/339 |
| 4,545,348 | 10/1985 | Ikeura | 123/339 |
| 4,667,632 | 5/1987 | Shimomura et al. | 123/339 |
| 4,738,237 | 4/1988 | Brandner et al. | 123/339 |

FOREIGN PATENT DOCUMENTS

| | | | |
|---|---|---|---|
| 0065538 | 4/1984 | Japan | 123/339 |
| 0116048 | 6/1986 | Japan | 123/339 |

*Primary Examiner*—Tony M. Argenbright
*Assistant Examiner*—Robert E. Mates
*Attorney, Agent, or Firm*—Sughrue, Mion, Zinn, MacPeak & Seas

[57] ABSTRACT

A method for adjusting idling RPM of engine having a pair of bypass passages, one of which is provided with a control valve and the other is provided with an air intake adjusting screw. The control valve is controlled by an adjusting signal (St+Sc) which is derived from an adjusting signal generator provided in a feedback system for decreasing the deviation of idling RPM of engine from a predetermined target RPM value after detecting it and the air intake adjusting screw is so adjusted as to make the adjusting signal to conform to the predetermined value (St) by decreasing the RPM correcting signal (Sc) independently of the said control value. With this arrangement there are no need of particular ways or arrangements for adjusting the idling RPM of the engine.

13 Claims, 5 Drawing Sheets

METHOD FOR ADJUSTING IDLING RPM OF ENGINE

The present invention is addressed to a novel method of adjusting an idling speed or revolutions (hereinafter referred to as RPM) of an engine having a feed back control system.

PRIOR ART OF THE INVENTION

In a prior art idling RPM control system, the idling RPM is adjusted to a predetermined value with an air intake adjusting screw provided in the path of intake air flow as by supplying a fixed driving signal to an air flow adjusting mechanism through which the air is fed to the engine and, then, keeping an amount of air intake to the engine constant.

The prior art method for adjusting the idling RPM is described more specifically in U.S. Pat. No. 4,364,347.

The prior art method requires a means for fixing a driving signal to be fed to an air flow adjusting mechanism to a predetermined value at the time of adjusting the idling RPM. This fixing of the driving signal has been done by installing a driving signal generator. Accordingly, the prior art method requires a driving signal generator as well as a switching means to alter the connections in case of adjusting the idling RPM of the engine.

Further, said prior art system involves a means for deriving a preset driving signal from a feedback control circuit at the time of adjusting the idling RPM. It is, however, apparent to a person skilled in the pertinent art that it is necessary to provide an input signal for switching the feed back control circuit to such an adjusting mode. As described above, according to the prior art method for adjusting the idling RPM of the engine, it has been necessary to install specific adjusting devices as well as the switching means in the air flow adjusting mechanism, and this has resulted in economic and operational problems in the idling RPM adjustment of an engine on a market of wide servicing network. Moreover, the prior art method is undesirable since there is a possibility of restarting the engine under such an unusual condition as failing to switch over the operating mode from the idle RPM adjusting mode to a normal driving mode.

SUMMARY OF THE INVENTION

It is therefore an object of the present invention to provide a method for adjusting idling RPM of an engine having the advantages of economical and simplified processes. A method for adjusting idling RPM of the engine according to the present invention comprises first means for generating an adjusting signal consisting of a target RPM signal and an RPM correcting signal to decrease the deviation of the RPM of the engine from the target RPM value after detecting an amount thereof, second means for controlling, by increasing or decreasing, an amount of air intake to the engine upon receipt of an output of the first means, and third means being capable of increasing or decreasing an amount of air intake to the engine independently of the second means, wherein said third means is so adjusted to minimize the RPM correcting signal of the adjusting signal generated by said first means for providing the target idling RPM of the engine.

According to the present invention, the adjustment of the idling RPM of the engine is carried out by utilizing a simple instrument, which is widely in use on the market, under a normal operating condition without fixing the operation of the air flow adjusting mechanism by generating a driving signal having a predetermined value.

BRIEF DESCRIPTION OF THE DRAWINGS

In the several figures, like reference numerals identify like elements, and in which.

DETAILED DESCRIPTION OF THE PREFERRED EMBODIMENTS

Figure 1:
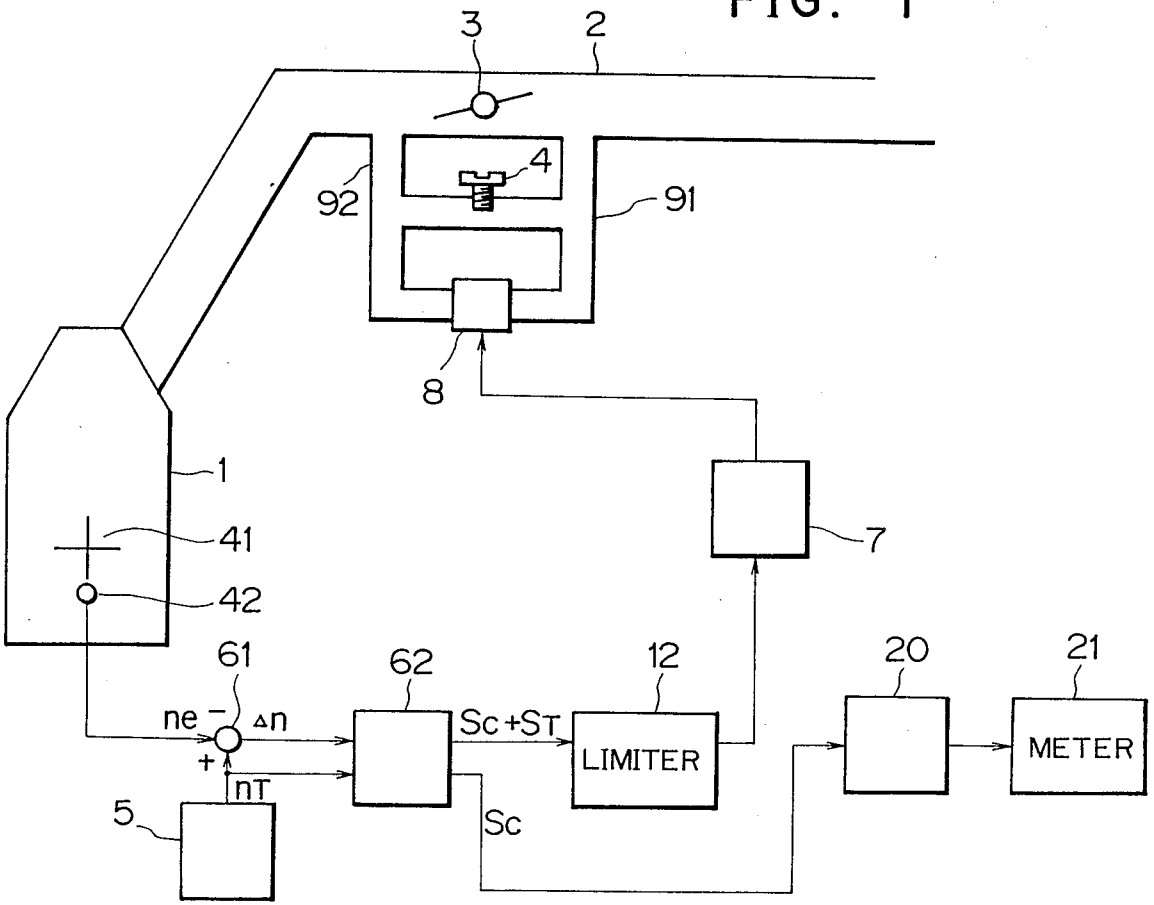
FIG. 1, FIG. 6 and FIG. 8 are preferred embodiments of this invention.

Preferred embodiments will be described more in detail with reference to the drawings. In an arrangement of FIG. 1, 1 denotes an internal combustion engine and 2 denotes an intake manifold thereof. A throttle valve 3 is provided at a suitable portion of the intake manifold 2 and this throttle valve 3 controls an RPM of the engine in response to the load. Bypassing paths 91, 92 are mounted to the manifold 2 across the throttle valve 3. The solenoid valve 8 which has a linear characteristic is mounted between the bypassing paths 91 and 92 for controlling an air intake that flows through one of bypass passages formed between the bypassing paths. This solenoid valve 8 is controlled by an output of a drive unit 7.

On the other hand, the internal combustion engine 1 is provided with a toothed wheel 41. The toothed wheel 41 rotates interlockingly with the revolutions of said internal combustion engine 1 and the revolutions of said toothed wheel 41 is, then, detected by an RPM sensor 42. The RPM sensor 42 detects the revolutions of the toothed wheel 41 and derives out an output of RPM $n_e$ of the engine to an RPM error signal amplifier 61. The RPM error signal amplifier 61 is also applied with an output $n_T$ of a target RPM generator 5 and generates an error signal $\Delta n$ by the computation for supplying a resultant to an RPM adjusting unit 62. The target RPM generator 5 is provided for generating a target RPM value of the no-loaded engine based on an operating condition such as an engine temperature and the like. The RPM adjusting unit 62 generates a target signal $S_T$, which will be used as a standard, in response to the target RPM $n_T$ and also generates an RPM correcting signal Sc in such a direction as to decrease the error signal $\Delta n$ by performing a proportional, integral or differentiating operation upon receipt of an output of said RPM error signal amplifier 61. The output $S_T+Sc$ of the RPM adjusting unit 62 is then fed to a limiter 12 which, then, limits the output of the RPM adjusting unit 62 for keeping it within a predetermined range. The output of the limiter 12 is fed in turn to the drive unit 7. The drive unit 7 derives a driving signal therefrom upon receipt of the output of said limiter 12 and the derived driving signal is fed to the solenoid valve 8. The solenoid valve 8 is controlled by this driving signal in such a way as to increase or decrease an opening of the bypass passage in accordance with the RPM correcting signal.

Figure 2:
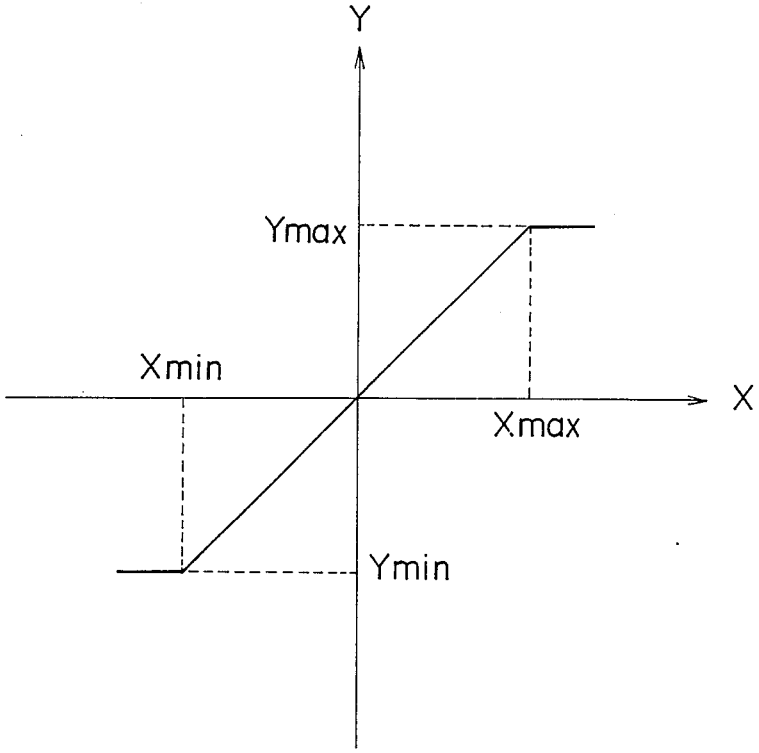
FIG. 2 through FIG. 5 are drawings illustrating the operation of the embodiment shown in FIG. 1; and, FIG. 7 is a drawing illustrating the operation of the embodiment shown in FIG. 6.
Figure 3:
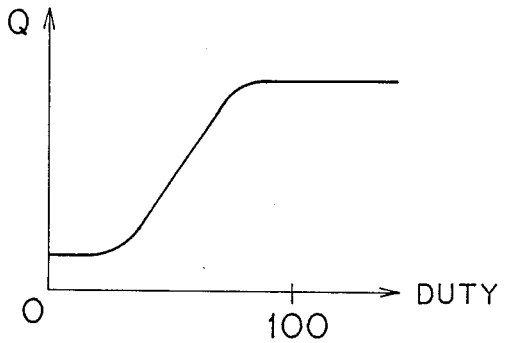

The operation of the arrangement above will be described hereinafter. The RPM adjusting unit 62 is brought into operation with the RPM error signal $\Delta n$ and generates the target signal $S_T$ and the RPM correcting signal Sc in response to the target RPM $n_T$ and the RPM error signal $\Delta n$ respectively. This RPM correcting signal Sc is generated in such a direction as to decrease the RPM error signal $\Delta n$ being derived from the RPM error signal amplifier 61 and settles down when the error signal reaches to the minimum. The output $S_T+Sc$ of the RPM adjusting unit 62 is given to the limiter 12. The characteristics of the limiter 12 is shown in FIG. 2 and thereby the limiter 12 generates an output Y which is proportional to an input X if the input X is within the range of $Xmin<X<Xmax$, however, the output Y of limiter 12 is limited either to Xmin or Xmax if the input X is out of said range. As it is obvious from the characteristics of the limiter 12 shown in FIG. 2, the output of the limiter 12 is transferred into the driving signal within the predetermined range for the solenoid valve 8 which is an air intake control valve to be driven by the drive unit 7. This driving signal is a duty signal as it is well known to a person skilled in the art. Since the relationship between a duty cycle to be applied to the solenoid valve 8 and a controlling amount Q for intake air to the engine has such characteristics as it is shown in FIG. 3, the increasing or decreasing of the amount of air intake can be performed by increasing or decreasing said duty cycle to be applied to the solenoid valve 8.

With the operation above, the RPM adjusting signal adjusts the RPM of the engine $n_e$ so as to make it in coincidence, substantially, with the target RPM $n_T$ by minimizing the error signal $\Delta n$. In other words, the change of thermal efficiency caused by scattered losses as well as temperatures at various parts of the engine and/or the change of load caused by various equipments such as lamps, motors etc can effectively be adjusted by the adjusting signal. A limiting value of the limiter 2 is determined appropriately by taking in consideration of a value that corresponds to the accumulation of errors being caused by the losses and the change of load at the various parts of the engine. Therefore, even if the RPM correcting signal is diverged in case of no RPM feed back due to a failure of the RPM sensor 42, the idling RPM adjustment is limited effectively by the limiter 12 and the target value for an amount of air intake will not be diverged, thus the RPM of the engine will be prevented from diverging.

Figure 4:
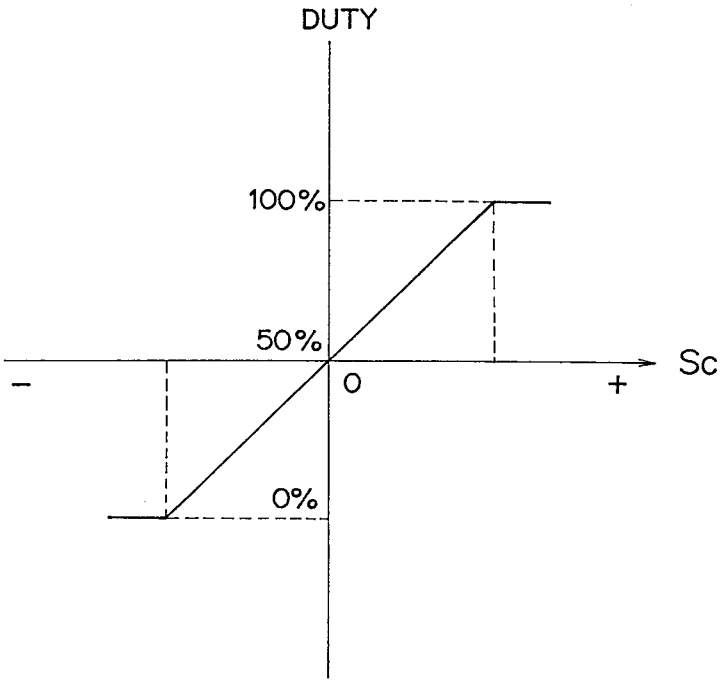

Next, the idling RPM adjustment of the embodiment shown in FIG. 1 will be explained more in detail, the correcting signal output circuit 20 converts the RPM correcting signal Sc, which is derived from the RPM adjusting unit 62, into a duty signal having the characteristics shown in FIG. 4 and yields an output to a meter 21 being connected at the outside thereof. The meter 21 is a volt meter and will give a meter indication that corresponds to an average voltage. Firstly, an operator adjusts the amount of air intake by using the adjusting screw 4 mounted in a bypass passage provided between the bypass paths 91, 92 in such a manner as to make an indication of the meter to correspond to a duty cycle of 50%. With this adjustment, the RPM correcting signal Sc becomes 0 in average and the solenoid valve 8 is driven only by the target signal $S_T$ that corresponds to the target RPM $n_T$, therefore, the RPM error caused by various reasons including the shortage of air intake causing from the choking of the throttle valve 3, the solenoid valve 8 and the like is corrected properly.

Figure 5:
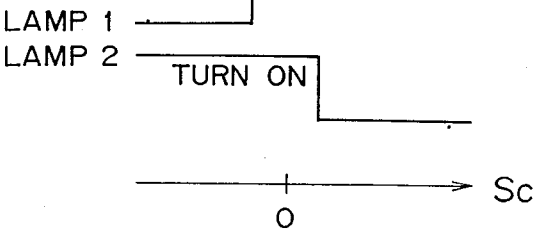

Although, the volt meter is used for the indication in the embodiment in FIG. 1, however, it is possible to employ two lamp indication circuits for discriminating the increasing or decreasing in the adjustment as it is shown in FIG. 5. In addition to this, a signal which is equivalent to the RPM correcting signal Sc may be derived from the correcting signal output circuit 20 as a code signal. Such code signal is equivalent to the contents of a memory that stores the RPM correcting signal Sc when the idling RPM is controlled by utilizing a computer.

In the embodiment of FIG. 1, the solenoid valve is utilized as the air intake control valve, however, it is needless to say that many kinds of valve such as a DC motor driven valve, a step motor driven valve and the like may be used as an air intake control valve.

Figure 7:
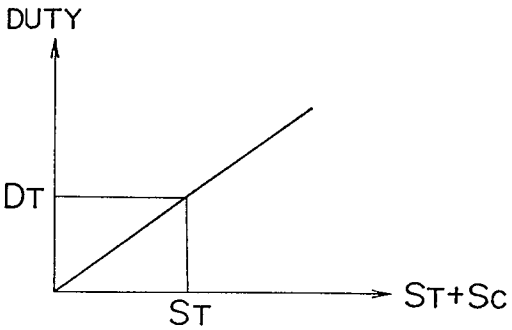
Figure 6:
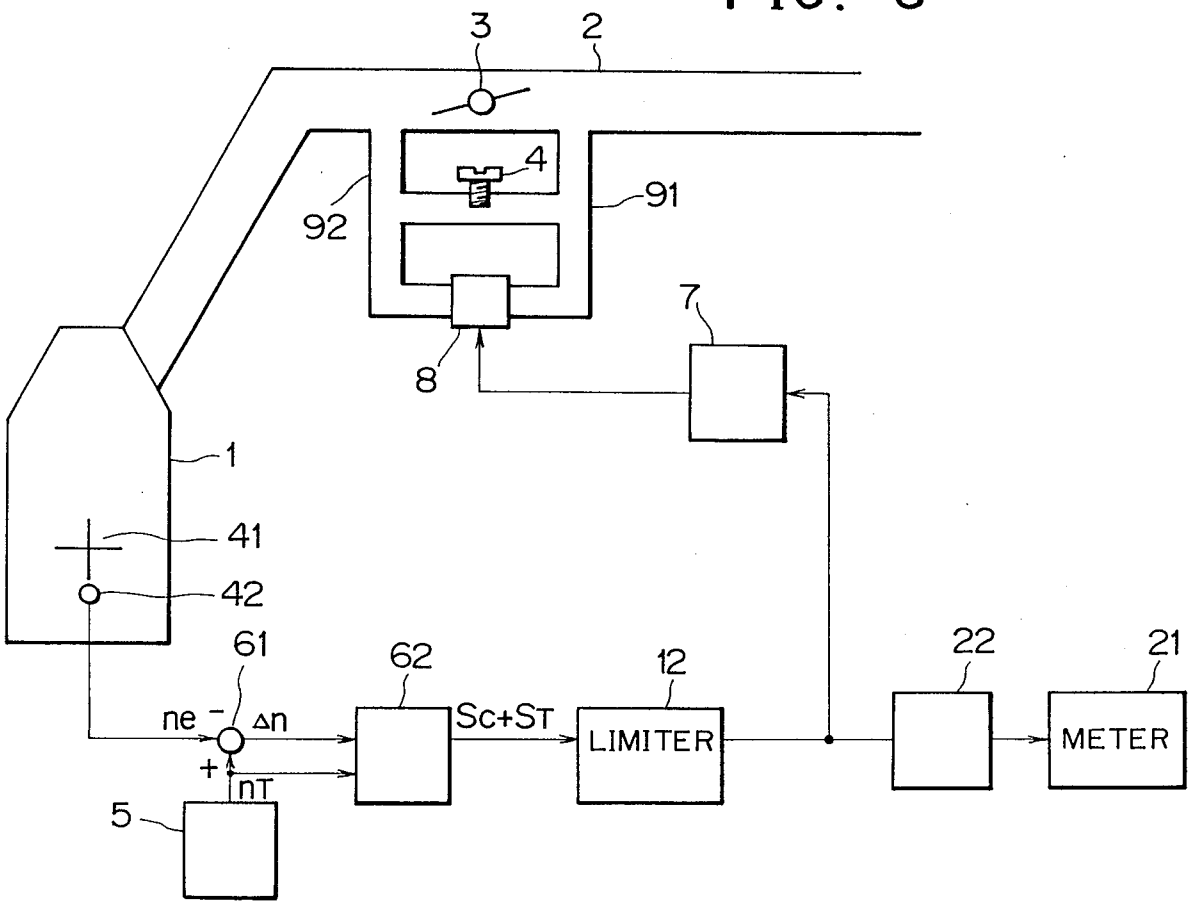

There is shown another embodiment of this invention in FIG. 6, wherein 22 is a driving signal output circuit and the output of limiter 12 is applied thereon. The operation of this embodiment is the same as that of the embodiment shown in FIG. 1 except the signal to be displayed during the adjustment. The characteristics of the driving signal output circuit 22 is shown in FIG. 7 and this driving signal output circuit 22 converts the output or $S_T+Sc$ of the limiter 12 into a duty signal. The derived duty signal is then displayed on the meter and the indication thereof is brought to $D_T$ by adjusting the air intake adjusting screw 4 for setting the driving signal to $S_T$ which is the predetermined standard value for keeping the RPM of the engine substantially at the target RPM $n_T$ as it is explained above. Accordingly, the RPM correcting signal Sc becomes minimum after this adjustment and there provided is the same result as that of the embodiment shown in FIG. 1.

Further, an input to the driving signal output circuit 22 corresponds to the driving duty cycle for the solenoid valve 8 in the embodiment of FIG. 6, however, it is needless to say that a signal which corresponds to a control position of a motor may be fed to the driving signal output circuit 22 as an input when the DC motor driven valve or step motor driven valve is utilized as an air intake control valve. Further, it is possible to use a code displaying unit other than the volt meter for the meter 21 in the same way as in the embodiment of FIG. 1.

Figure 8:
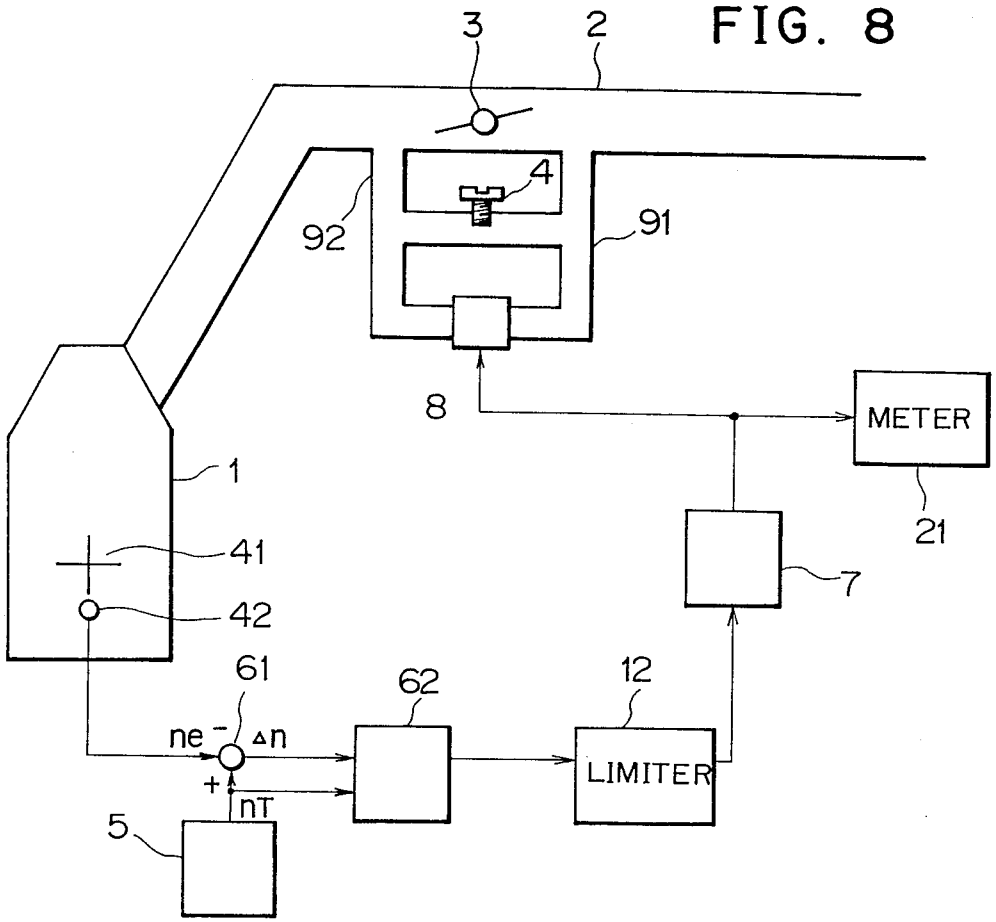

FIG. 8 shows a still another embodiment of this invention, wherein an output of the drive unit 7 is fed to the meter 21. The meter 21 indicates a value which corresponds to the duty cycle of the duty signal which drives the solenoid valve 8 and this valve is equivalent, substantially, to the $S_T+Sc$ illustrated as being related to the embodiment in FIG. 6. The driving duty cycle Ds that corresponds to the $S_T$ is determined in advance from the characteristics of the solenoid valve 8, therefore, by adjusting the air intake adjusting screw for making the duty cycle to Ds after measuring the driving duty cycle directly through the meter 21, the RPM correcting signal Sc will become 0 and there provided is the same result as that of the embodiment shown in FIG. 6.

As it is described in the foregoing specification, the method according to the invention requires no need of fixing the driving signal generator output to a predetermined value in order to fix the air intake valve or the air flow adjusting mechanism, which has been required in the prior art method, at the time when adjusting the idling RPM of the engine with the adjusting screw. Therefore, there is no need of changing the connections for the air intake valve in the idle adjustment as well as no need of generating an input for switching the output of RPM adjusting unit to a fixed value. In addition, a volt meter widely used on the market can be utilized as the meter for the use in the adjustment. Therefore, the expenses are negligible for the adjustment and, moreover, the adjustment is very simple to carry out.

Whilst the invention has been described with reference to preferred embodiments, it will be understood by those skilled in the art that various changes may be made and equivalents may be substituted for elements thereof without departing from the scope of the invention as set forth in the appended claims. It is intended that the invention not be limited, accordingly, to the particular embodiments but that the specification and the drawings are to be regarded in an illustrative rather than a restrictive sense.

What is claimed is:

1. A method of adjusting an idling speed of an internal combustion engine having an intake passage, a throttle valve in the intake passage, first and second bypass passages each separately communicating with the intake passage so as to bypass the throttle valve, a flow rate control means for controlling the flow rate through the first bypass passage, and an adjustable device for adjusting the flow rate through the second bypass passage, the method comprising the steps of:

generating, as a varying adjustment signal, a target signal and a correctional signal, the target signal representing a target engine idling speed, and the correction signal representing a difference between a detected engine idling speed and the target engine idling speed;

controlling said flow rate control means in accordance with the generated varying adjustment signal; and adjusting said adjustable device so as to decrease an absolute value of said correction signal, said adjusting step being performed at a time when said controlling step is performed.

2. The method as defined in claim 1, further comprising the step of monitoring said adjustment signal.

3. The method as defined in claim 1, further comprising the step of monitoring only the correction signal of said adjustment signal.

4. The method as defined in claim 1, further comprising the steps of:

detecting at least one of losses and temperatures at predetermined engine elements; and generating said target engine idling speed in accordance with said detected losses and temperatures.

5. The method as defined in claim 1, further comprising the step of limiting a value of said generated varying adjustment signal to within a predetermined range of values.

6. The method as defined in claim 1, wherein said controlling step controls the amount of air intake to the engine through the first bypass passage in a linear fashion.

7. The method as defined in claim 1, further comprising the step of providing an analog representation of the generated varying adjustment signal.

8. The method as defined in claim 1, further comprising the step of providing a digital representation of the generated varying signal.

9. The method as defined in claim 1, wherein said controlling step comprises the steps of:

generating a driving signal in accordance with the generated adjustment signal; and applying said generated driving signal to said flow rate control means.

10. The method as defined in claim 9, further comprising the step of monitoring said generated driving signal.

11. The method as defined in claim 1, further comprising the step of displaying the correction signal.

12. The method as defined in claim 1, further comprising the step of converting said correction signal into a duty signal.

13. The method as defined in claim 12, wherein the internal combustion engine includes a meter for measuring the duty signal, and wherein the adjusting step includes adjusting said adjustable device so that the meter measures a 50% duty signal.

* * * * *